US006427385B1

(12) United States Patent
Fin

(10) Patent No.: US 6,427,385 B1
(45) Date of Patent: Aug. 6, 2002

(54) WINDOW LIFT MECHANISM

(75) Inventor: Enrico Fin, Lake Orion, MI (US)

(73) Assignee: Meritor Light Vehicle Technology, LLC, Troy, MI (US)

( * ) Notice: Subject to any disclaimer, the term of this patent is extended or adjusted under 35 U.S.C. 154(b) by 0 days.

(21) Appl. No.: 09/761,319

(22) Filed: Jan. 16, 2001

(51) Int. Cl.[7] ..... E05F 11/24
(52) U.S. Cl. ..... 49/340; 49/362
(58) Field of Search ..... 49/362, 348, 349, 49/502, 209, 213, 214

(56) References Cited

U.S. PATENT DOCUMENTS

| | | | | | |
|---|---|---|---|---|---|
| 468,206 | A | | 2/1892 | Parker | |
| 2,731,261 | A | * | 1/1956 | Drum | 49/349 |
| 2,872,184 | A | * | 2/1959 | Wise | 49/349 |
| 2,947,535 | A | * | 8/1960 | Crosby | 49/349 |
| 2,955,816 | A | * | 10/1960 | Wise | 49/349 |
| 3,691,684 | A | | 9/1972 | Boneck | |
| 4,183,178 | A | | 1/1980 | Kiefer et al. | |
| 5,012,613 | A | | 5/1991 | Sekine | |
| 5,103,126 | A | * | 4/1992 | Mehnert | 49/362 |
| 5,142,824 | A | * | 9/1992 | Le Compagnon et al. | 49/349 |
| 5,219,146 | A | | 6/1993 | Thompson | |

* cited by examiner

*Primary Examiner*—Jerry Redman
(74) *Attorney, Agent, or Firm*—Carlson, Gaskey & Olds

(57) ABSTRACT

A window lift mechanism is provided that includes a mounting member and one or more guides which may be integrally formed with the mounting member. The guide includes a cross-sectional shape and defines a path along which the window panel moves. A glass bar assembly is supported on the guide and is movable relative thereto along the path. The glass bar assembly includes a glass bar that supports the glass panel and a drive block that moves relative to the glass bar in a direction transverse to the guide path. A drive mechanism, which preferably includes a worm gear and a drive motor, is supported on the mounting member. The drive motor and the worm gear are supported by a support and a bracket, which are integrally formed with the mounting member. The worm gear is received within a threaded aperture in the drive block. The drive motor rotatingly drives the worm gear to move the glass bar assembly along the path defined by the guides. Movement between the glass bar and the drive block accommodate the curved motion of the glass bar and window panel as it is raised and lowered from the door. Clearance is provided between the glass bar and the guides to permit movement of the window panel.

20 Claims, 1 Drawing Sheet

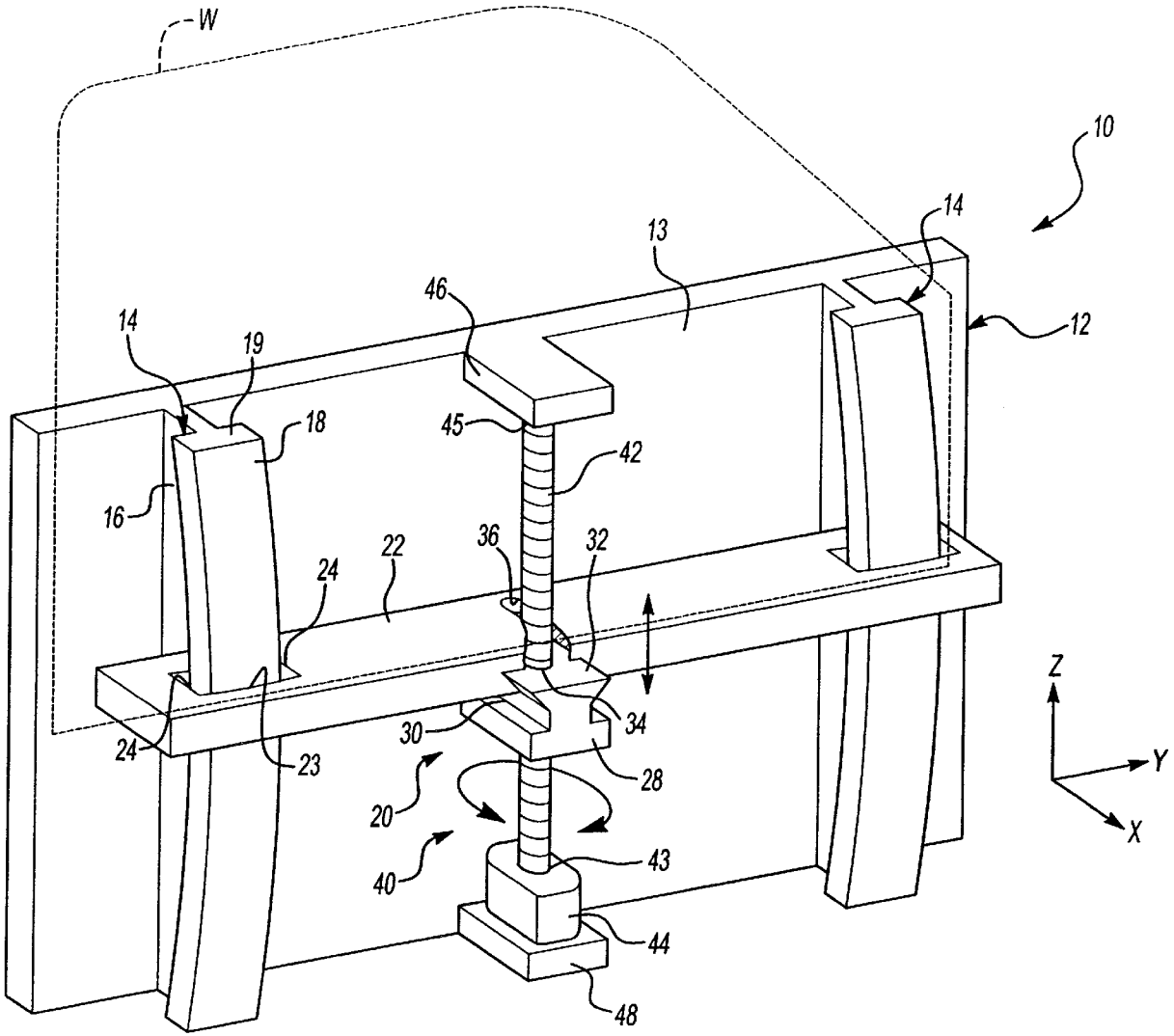
10
12
14
13
42
32
34
28
43
44
48
46
45
36
30
20
40
22
24
18
23
19
14
16
24
W
Z
Y
X

WINDOW LIFT MECHANISM

BACKGROUND OF THE INVENTION

This invention relates to a window lift mechanism for opening and closing a vehicle window, and more particularly, the invention relates to a window lift mechanism door module.

Window lift mechanisms are used to raise and lower a panel from a vehicle door cavity. Commonly window panels have a curve corresponding to the outside profile of the vehicle body door. The curve of the window panel prevents the window panel from being moved up and down along a plane. As a result, the guides along which the window panel moves and the drive mechanism have typically been rather complicated in an effort to accommodate this curved motion.

Numerous components have been used to construct the guides and support the drive mechanism that moves the window panel along the guides. Still, further components have been used to secure the guides and drive mechanism to the door structure. The many components previously used have added costs to window lift mechanisms.

Window lift mechanisms must accommodate slight shaking and shifting of the glass panel as it is moved up and down so that the window panel does not bind. However, the more the glass panel is permitted to move, the more likely it is noise that may result. It is difficult to provide a window lift mechanism that provides the necessary stability while raising or lowering the glass panel while reducing the number of window lift mechanism components. Therefore, what is needed is a window lift mechanism utilizing a limited number of components while permitting the glass panel to move slightly without increasing noise.

SUMMARY OF THE INVENTION AND ADVANTAGES

The present invention provides a window lift mechanism that includes a mounting member and one or more guides which may be integrally formed with the mounting member. The guide includes a cross-sectional shape and defines a path along which the glass panel moves. A glass bar assembly is supported on the guide and is movable relative thereto along the path. The glass bar assembly includes a glass bar that supports the window panel and a drive block that moves relative to the glass bar in a direction transverse to the guide path. A drive mechanism, which preferably includes a worm gear and a drive motor, is supported on the mounting member. The drive motor and the worm gear are supported by a support and a bracket, which may be integrally formed with the mounting member. The worm gear is received within a threaded aperture in the drive block. The drive motor rotatingly drives the worm gear to move the glass bar assembly along the path defined by the guides. Movement between the glass bar and the drive block accommodate the curved motion of the glass bar and window panel as it is raised and lowered from the door. Clearance is provided between the glass bar and the guides to permit fore/aft movement of the window panel.

Accordingly, the above invention provides a window lift mechanism utilizing a limited number of components while permitting the glass panel to move slightly without increasing noise.

BRIEF DESCRIPTION OF THE DRAWINGS

Other advantages of the present invention can be understood by reference to the following detailed description when considered in connection with the accompanying drawing wherein the FIGURE is a perspective view of the present invention window lift mechanism.

DETAILED DESCRIPTION OF THE PREFERRED EMBODIMENT

A window lift mechanism 10 is shown in the FIGURE. The window lift mechanism 10 includes a mounting member 12 having a surface 13. The mounting member 12, which is preferably constructed from plastic, includes spaced apart guides 14 integrally formed with the mounting member 12 and defined by surface 13. While a pair of guides 14 are shown any number of guides may be suitable. The guides 14 include ribs 16 extending outward and terminating at a profile 18 which defined a path of movement. The profile 18 may have any suitable cross-sectional shape as will be appreciated from the discussion below, but preferably includes opposing flanges 19.

A glass bar assembly 20 is slidably supported on the guides 14. The glass bar assembly 20 includes a glass bar 22 for supporting a window panel W and a drive block 28 keyed to the glass bar 22. The glass bar 22 includes openings 23 generally of a complimentary shape to the profile 18 so that the guides 14 may retain and guide the glass bar 22 as it travels along the path defined by the guides 14. The opening 23 is preferably slightly larger than the profile 18 particularly in the Y direction, as shown by gaps 24, to permit slight lateral movement in the Y direction. This lateral movement permits the window panel W to move slightly in the lateral direction to prevent binding in the window lift mechanism. As may be appreciated, the profile 18 and opening 23 may be of any complimentary shape.

Window panels are typically curved, and as a result, the guides 14 have a curved profile 18 to move the window panel W along a curved path. As the glass bar 22 moves along the guides 14, the glass bar 22 moves in and out in the X direction. Accordingly, the drive block 28 and glass bar 22 are keyed to one another to permit sliding movement of the glass bar 22 and drive block 28 relative to one another in the X direction, which is transverse to the path defined by the guides 14. The glass bar 22 includes a channel 30 which receives a slide 32 extending from the drive block 28. As the glass bar 22 travels upward and downward along the guide 14 the channel 30 will move in the drive block 28 in the X direction. It is to be understood that the channel 30 and the slide 32 may be of any complimentary shape and that the channel 30 may be arranged in the drive block while the slide 32 may be arranged in the glass bar 22.

A drive mechanism 40 raises and lowers the glass bar assembly 20 and the attached window panel W. The drive mechanism 40 includes a worm gear 42 having an end 43 that is secured to a drive motor 44 that rotatingly drives the worm gear 42. An opposing end 45 of the worm gear 42 is supported by a support 46 that is defined by surface 13 of the mounting member 12. Said another way, the support 46 is integrally formed with the mounting member 12. The mounting member 12 also includes a bracket 48 integrally formed therewith that supports the drive motor 44. Preferably the drive motor 44 directly drives the worm gear 42 without the need for gear reduction components.

The worm gear 42 is received within a threaded aperture 34 in the drive block 28. The glass bar 22 includes a slot 36 that is at least partially aligned with the threaded aperture 34 to permit the worm gear 42 to extend through the glass bar 22. The slot is elongated and arranged along the X direction. As the drive motor 44 rotatingly drives the worm gear 42, the drive block 28 moves in the Z direction. However, since the guides 14 are curved the glass bar 22 must move in the X direction as it moves upward and downward in the Z direction. Accordingly, the slot 36 accommodates the worm gear 42 as the glass bar 22 moves in the X direction.

The window lift mechanism 10 of the present invention is forced-entry resistant due to the relationship between the worm gear 42 and the drive block 28. When an intruder attempts to force the window panel W in a downward direction the worm gear 42 will not rotate. The worm gear 42 only rotates in response to the rotating drive provided by drive motor 44.

Integrally forming the support 46, bracket 48 and guides 14 with the mounting member 12 eliminates numerous components and fasteners. Furthermore, alignment of all the window lift components is better insured. Although the present invention window lift mechanism eliminates many components previously used in window lift mechanisms, adequate free play or movement of the window panel W is permitted without increasing noise of reducing reliability.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A window lift mechanism comprising:

a mounting member;

a guide on said mounting member defining a path;

a glass bar supported on said guide and moveable relative thereto along said path;

a drive block supported on said glass bar and moveable relative thereto in a direction transverse to said path and said glass bar; and a drive mechanism connected to said drive block for moving said drive block and said glass bar along said path.

2. The window lift mechanism according to claim 1, wherein said glass bar and said drive block are keyed together to permit sliding movement between said glass bar and said drive block in said direction transverse to said path.

3. The window lift mechanism according to claim 1, wherein said drive block includes a threaded aperture receiving a portion of said drive mechanism.

4. The window lift mechanism according to claim 1, wherein said mounting member includes a pair of said guides with said worm gear arranged between said guides.

5. The window lift mechanism according to claim 1, wherein said path is non-linear.

6. A window lift mechanism comprising:

a mounting member;

a guide on said mounting member defining a path;

a glass bar supported on said guide and moveable relative thereto along said path;

a drive block supported on said glass bar and moveable relative thereto in a direction transverse to said path; and a drive mechanism connected to said drive block for moving said drive block and said glass bar along said path, wherein said drive block includes a threaded aperture receiving a portion of said drive mechanism and said glass bar includes a slot at least partially aligned with said threaded aperture for permitting said portion to extend through said glass bar.

7. The window lift mechanism according to claim 6, wherein said drive mechanism includes a worm gear disposed within said threaded aperture for rotation therein and a drive motor for rotatingly driving said worm gear.

8. A window lift mechanism comprising:

a mounting member;

a guide on said mounting member defining a non-linear path;

a glass bar assembly supported on said guide and moveable relative thereto along said path, said glass bar assembly including a threaded aperture;

a worm gear in spaced relationship from said guide and disposed within said threaded aperture for rotation therein; and a drive motor rotatingly driving said worm gear for moving said glass bar assembly along said path.

9. The window lift mechanism according to claim 8, wherein said drive motor is coaxial with said worm gear.

10. The window lift mechanism according to claim 9, wherein said mounting member includes a support with said worm gear extending between said support and said drive motor.

11. The window lift mechanism according to claim 10, wherein said mounting member includes a bracket opposite said support with said drive motor supported on said bracket.

12. A window lift mechanism comprising:

a mounting member having a surface;

a guide defined by said surface and including a cross-sectional shape, said guide defining a path;

a glass bar assembly supported on said guide and moveable relative thereto along said path, said glass bar assembly having an opening with a shape complimentary to said cross-sectional shape for slidingly receiving said guide; and a drive mechanism connected to said glass bar assembly for moving said glass bar assembly along said path.

13. The window lift mechanism according to claim 12, wherein said drive mechanism includes a worm gear and a drive motor driving said worm gear.

14. The window lift mechanism according to claim 13, wherein said glass bar assembly includes a glass bar and a drive block supported on said glass bar and moveable relative thereto in a direction transverse to said path.

15. The window lift mechanism according to claim 14, wherein said worm gear is received in a threaded aperture in said drive block.

16. The window lift mechanism according to claim 13, further including a support defined by said surface for supporting an end of said worm gear.

17. The window lift mechanism according to claim 16, further including a bracket defined by said surface for supporting said drive motor, said drive motor supporting an opposing end from said end of said worm gear.

18. The window lift mechanism according to claim 12, wherein said opening includes a gap between said guide and said glass bar assembly.

19. The window lift mechanism according to claim 12, wherein said mounting member includes a pair of guides.

20. The window lift mechanism according to claim 12, wherein said mounting member is molded from plastic.

* * * * *